US006588074B2

(12) United States Patent
Galkiewicz et al.

(10) Patent No.: US 6,588,074 B2
(45) Date of Patent: Jul. 8, 2003

(54) SELF-MATING RECLOSABLE BINDING STRAP AND FASTENER

(75) Inventors: Robert K. Galkiewicz, Roseville, MN (US); Graham M. Clarke, Woodbury, MN (US); Ronald W. Ausen, St. Paul, MN (US); Brian E. Spiewak, Inver Grove Heights, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 197 days.

(21) Appl. No.: 09/758,885

(22) Filed: Jan. 11, 2001

(65) Prior Publication Data

US 2001/0013277 A1 Aug. 16, 2001

Related U.S. Application Data

(63) Continuation-in-part of application No. 09/501,900, filed on Feb. 10, 2000, and a continuation-in-part of application No. 09/569,140, filed on May 11, 2000.

(51) Int. Cl.[7] ..... B65D 63/00; A44B 18/00

(52) U.S. Cl. ..... 24/586.1; 24/16 PB; 24/306; 24/452

(58) Field of Search ..... 24/306, 442, 452, 24/585.12, DIG. 39, DIG. 50, 16 R, 16 PB

(56) References Cited

U.S. PATENT DOCUMENTS

| | | | | |
|---|---|---|---|---|
| 1,164,697 | A | | 12/1915 | Alsop |
| 2,532,011 | A | | 11/1950 | Dahlquist et al. |
| 2,717,437 | A | | 9/1955 | De Mestral |
| 2,772,469 | A | | 12/1956 | Staller et al. |
| 3,009,235 | A | | 11/1961 | De Mestral |
| 3,266,113 | A | | 8/1966 | Flanagan, Jr. |
| 3,495,306 | A | * | 2/1970 | Eichberg ..... 24/586.1 |
| 3,586,220 | A | | 6/1971 | Reinsberg |
| 3,879,835 | A | | 4/1975 | Brumlik |

(List continued on next page.)

FOREIGN PATENT DOCUMENTS

| | | |
|---|---|---|
| DE | 31 13 020 A1 | 11/1982 |
| EP | 0 046 465 A1 | 3/1982 |
| EP | 0 325 528 A1 | 1/1989 |
| EP | 0 381 906 B1 | 2/1993 |
| EP | 0 793 923 | 9/1997 |
| EP | 0 250 248 | 11/1997 |
| EP | 0 904 707 | 3/1999 |
| EP | 1 034 715 A2 | 9/2000 |
| FR | 2 760 974 A1 | 9/1998 |
| JP | Hei 8-187113 | 7/1996 |
| JP | 10 245067 | 9/1998 |
| WO | WO 91/19433 | 12/1991 |
| WO | WO 92/15626 | 9/1992 |
| WO | WO 99/17630 | 4/1999 |
| WO | WO 99/17631 | 4/1999 |

*Primary Examiner*—Robert J. Sandy

(57) ABSTRACT

A new method of binding at least one article, and a new binding strap for use in binding an article or articles is taught. The new binding strap for preferred use in practicing the new method comprises an elongate base sheet having an array of parallel, narrowly spaced, elastically deformable ribs projecting integrally from the base sheet; the ribs comprising a stem portion attached to and substantially upright from the base sheet and a flange attached to at least one side of the stem portion and spaced from the base sheet; the array of ribs establishing a first fastening surface that can be pressed against and thereby interconnected with an identical fastening surface; the underside surface of the outer portion of at least some flanges projecting downwardly toward the base sheet; and the flange having a substantial thickness over most of its width such that the stem portion deforms in preference to the flange during peel-type disengagement from an identical fastening surface; and the strap having a length and width adapting the strap to be wrapped around one or more articles to apply a binding action on the article(s).

50 Claims, 10 Drawing Sheets

U.S. PATENT DOCUMENTS 4,056,593 A 11/1977 de Navas Albareda
4,169,303 A 10/1979 Lemelson
4,215,687 A 8/1980 Shaw
4,290,174 A 9/1981 Kalleberg
4,313,988 A 2/1982 Koshar et al.
4,482,687 A 11/1984 Noshay et al.
4,576,664 A 3/1986 Delahunty
4,596,540 A 6/1986 F'Geppert
4,672,722 A 6/1987 Malamed
4,684,559 A 8/1987 Wasko
4,706,914 A 11/1987 Ground
4,728,553 A 3/1988 Daniels
4,731,911 A 3/1988 Gould
4,792,240 A * 12/1988 Ausnit ..... 383/63
4,794,674 A 1/1989 Mintel et al.
4,872,243 A 10/1989 Fischer
4,894,060 A 1/1990 Nestegard
4,963,410 A 10/1990 Bryant
5,048,158 A * 9/1991 Koerner ..... 24/16 R
5,067,210 A 11/1991 Kayaki
5,119,531 A 6/1992 Berger et al.
5,168,603 A 12/1992 Reed
5,177,986 A 1/1993 Jensen
5,230,851 A 7/1993 Thomas
5,235,731 A 8/1993 Anzai et al.
5,260,015 A 11/1993 Kennedy et al.
5,325,569 A 7/1994 Goulait et al.
5,374,262 A 12/1994 Keuhn, Jr. et al.
RE34,832 E 1/1995 Lechuga
5,393,475 A 2/1995 Murasaki et al.
5,396,687 A 3/1995 Osterman
5,398,387 A 3/1995 Torigoe et al.
5,460,308 A 10/1995 Hahn
5,505,747 A 4/1996 Chesley et al.
5,548,871 A 8/1996 Trethewey
5,604,961 A * 2/1997 Cole ..... 24/306
5,685,050 A 11/1997 Murasaki
5,733,652 A 3/1998 Stowman et al.
5,802,676 A 9/1998 Tolan
5,860,194 A 1/1999 Takizawa et al.
5,870,849 A 2/1999 Colson, Jr.
5,888,621 A 3/1999 Frohlich et al.
5,902,427 A * 5/1999 Zinke et al. ..... 156/73.1
6,044,525 A 4/2000 Sastre et al.

* cited by examiner

SELF-MATING RECLOSABLE BINDING STRAP AND FASTENER

RELATED APPLICATION

This application is a continuation-in-part of application Ser. No. 09/501,900, filed Feb. 10, 2000, and of application Ser. No. 09/569,140, filed May 11, 2000; the contents of both applications are incorporated herein by reference.

FIELD OF THE INVENTION

This invention particularly relates to binding straps having fastening means by which the strap may be wrapped around an article or articles and fastened in place; the invention also pertains to the general field of recallable self-mating fasteners.

BACKGROUND OF THE INVENTION

Reclosable fastener products have long been sought as replacement candidates for common bundling products such as cable ties. Some examples of prior efforts are illustrated in U.S. Pat. Nos. 1,164,697; 3,586,220; 4,169,303; 4,215,687; 4,684,559; 4,706,914; 4,963,410; and 5,177,986. But most of the suggested products include fastening structures that are bulky and two-part in nature, such as hook-and-loop fasteners or male-female fastener pairs, which tend to be too expensive for many applications and to have other significant disadvantages. Other suggested products have inadequate peel strength or other properties that are desired for a bundling use.

SUMMARY OF THE INVENTION

The present invention provides a new method for binding an article or group of articles, and further provides a new binding strap for carrying out such a binding operation. The new method generally comprises at least partially surrounding at least one article with a first elongate strap portion that comprises a base sheet configured on at least one surface with an array of parallel, narrowly spaced, elastically deformable ribs that project integrally from the base sheet. The array of ribs establishes a first self-mating fastening surface, i.e., the fastening surface can be pressed against and thereby interconnected with an identical fastening surface. The ribs comprise a stem portion attached to and substantially upright from the base sheet and a flange attached to at least one side of the stem portion and spaced from the base sheet. The outer portion of the underside surface of at least some flanges projects toward the base sheet; and at least some flanges have a substantial thickness over most of their width such that the stem portion deforms in preference to the flange during peel-type disengagement from an identical fastening surface. To bind the article, the first fastening surface is interconnected with a second fastening surface carried on a further structural member, which may take various forms, including, for example, a second strap portion, or a separate structural member such as a flat panel provided with a fastening surface.

Some methods of the invention use a single binding strap, as when the further structural member is a second strap portion integrally connected to the first strap portion; and the second fastening surface is typically identical to (i.e., self-mating with) the first fastening surface. The strap may include one or more openings through which one or both ends of the strap may be inserted to complete a binding operation. The first and second fastening surfaces may be disposed on the same major side of a single strap, or they may be disposed on opposite sides of the strap. Some methods use a double-sided binding strap, i.e., a binding strap having a fastening surface on each side of the strap.

When the further structural member used in a method of the invention is a panel or other member separate from the binding strap, the panel may have an opening, and the second fastening surface is carried on the panel adjacent to the opening. Binding can be accomplished by inserting the ends of the first elongate strap portion through the opening and interconnecting the first and second fastening surfaces.

A new binding strap of the invention, useful in a method as described, generally comprises an elongate base sheet having a multiplicity of parallel, narrowly spaced, elastically deformable ribs projecting integrally from the base sheet; the ribs comprising a stem portion attached to and substantially upright from the base sheet and a flange attached to at least one side of the stem portion and spaced from the base sheet; and the array of ribs establishing a first fastening surface that is self-mating. The flanges have a substantial thickness over most of their width such that the stem portions deform in preference to the flanges during peel-type disengagement from an identical fastening surface. Preferably a flange is attached on each side of the stem portion, and at least the outer portions of the underside surface of the flanges project downwardly toward the base sheet to further enhance the strong interconnection achieved by straps of the invention. The strap has a length and width that adapts the strap to be wrapped around one or more articles to apply a binding action on the article(s). Often the binding strap is in tension during such a binding action.

The easiest interengagement of fastening surfaces is obtained when the cross-sectional profile of the array of ribs is substantially uniform over the length of the ribs, but in the direction transverse to the ribs has a regularly repeated deviation from the profile that would be formed by a full population of equally spaced, identical, undivided, symmetric ribs. Preferably such a deviation in profile is provided by using ribs that vary in height one-by-one across the width of the profile.

An important advantage of a new binding strap of the invention is that it can be made by profile extrusion, which establishes an ability to prepare binding straps that meet the cost constraints often present in binding uses. The binding strap can be cut from an extruded polymeric web, with the length of the strap preferably transverse to the machine direction of extrusion, so the ribs are transverse to the length of the strap; straps in which the ribs extend parallel to the length of the strap are also useful and are advantageous for some purposes.

DETAILED DESCRIPTION

Figure 1:
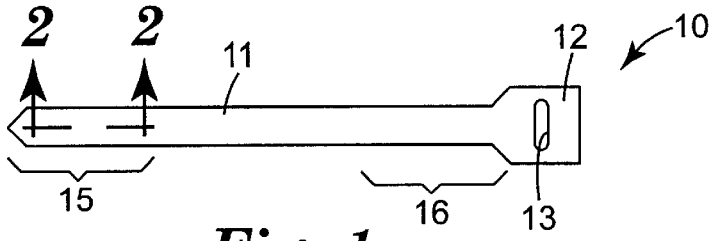
FIG. 1 is a plan view of one representative binding strap of the invention.
Figure 1A:
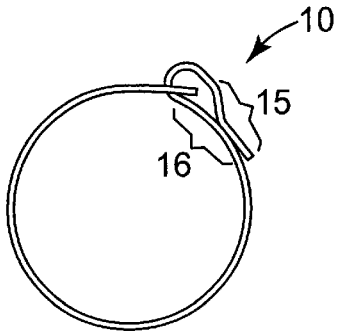
FIGS. 1*a* and 1*b* are schematic side views illustrating the binding strap of FIG. 1 in use.
Figure 1B:
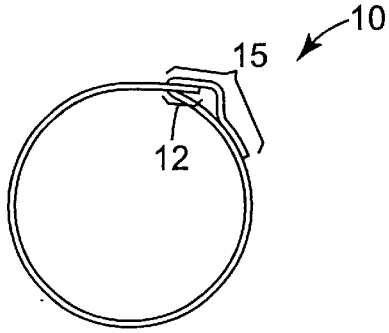

An illustrative binding strap of the invention 10 is shown in plan view in FIG. 1 and in an illustrative use in FIGS. 1*a* and 1*b*. The binding strap 10 includes a main strap portion 1, a head portion 12, and an opening 13 in the head portion for receiving an end of the strap after the strap has been wrapped around an object or group of objects. The external surface of the main strap portion 11 (i.e., the side away from the space surrounded by the strap in FIGS. 1*a* and 1*b*) is provided with a fastening surface at least on the portion 15 that passes through the opening 13 and on the portion 16 adjacent to the opening 13, whereby the first end portion 15 can be folded back after insertion through the opening and fastened to the second portion 16 in the manner shown in FIG. 1*a*. Further, when the head portion 12 carries a fastening surface, the folded-back first end portion 15 can interconnect with the fastening surface on the head portion as illustrated in FIG. 1*b*, either instead of or in addition to (as shown in FIG. 1*b*) interconnecting with the fastening surface in the area 16.

Figure 2:
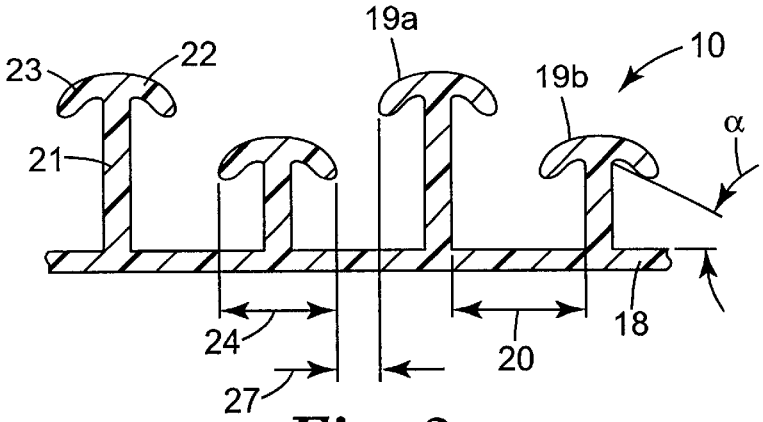
FIG. 2 is an enlarged sectional view of a portion of the binding strap of FIG. 1, taken along the lines 2—2 in FIG. 1.
Figure 3:
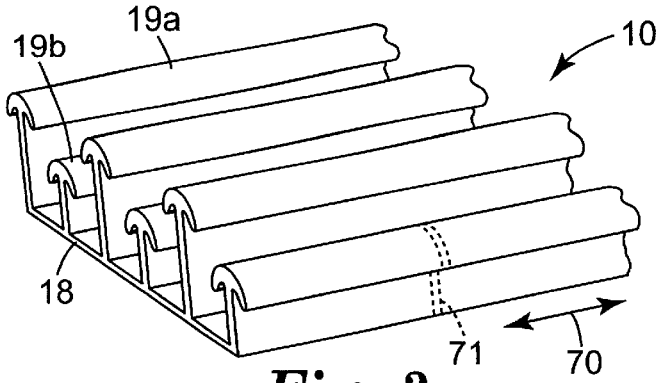
FIG. 3 is an enlarged perspective view of a portion of the binding strap of FIG. 1.

Parts of the fastening surface of the binding strap 10, which is a preferred fastening surface for use in the invention, are shown in an enlarged side view in FIG. 2 and in a partial perspective view in FIG. 3. As illustrated in FIG. 2, the binding strap 10 comprises a base sheet 18 and a multiplicity of ribs 19 attached to and projecting upwardly from the base sheet. The ribs have different heights, with tall ribs 19*a* alternating one-by-one with shorter ribs 19*b*. The ribs 19 are parallel to one another and equally spaced apart a transverse distance 20. Each rib comprises a stem portion 21 and a flange, 22 and 23, attached to each side of the stem portion at a point spaced from the base sheet 18. Both flanges 22 and 23 extend at an angle ($\alpha$) from their point of attachment on the stem portion 21 toward the base sheet 18, with the result that at their outer or lateral edge the flanges are closer to the base sheet than are their points of attachment to the stem portion.

Figure 4A:
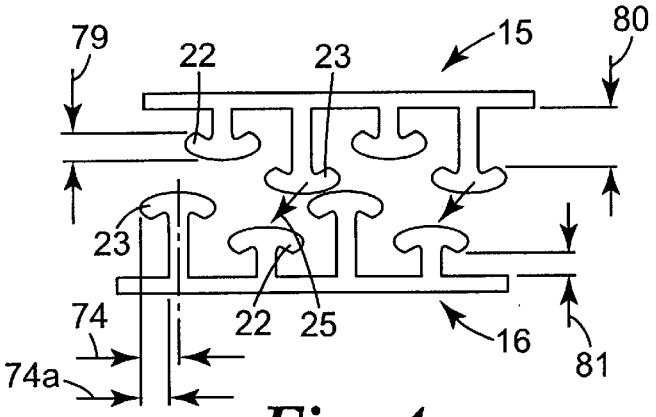
FIGS. 4*a*–4*d* are schematic side views of two fastening surfaces of the binding strap of FIGS. 1–3 undergoing interengagement.
Figure 4B:
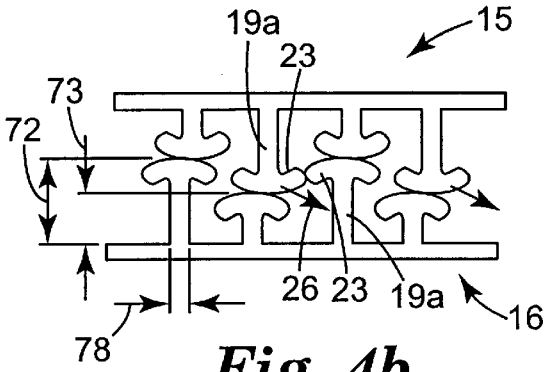
Figure 4C:
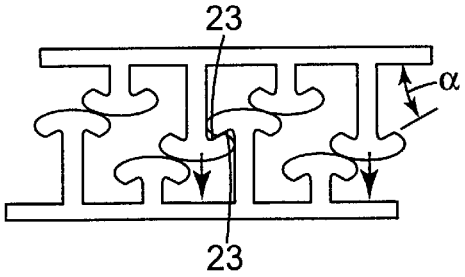
Figure 4D:
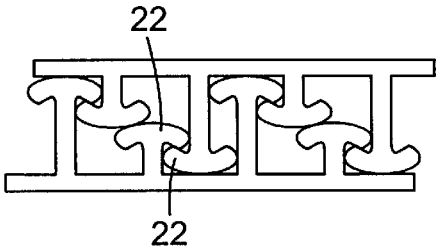

The fastening surface illustrated in FIG. 2 is a self-mating, recallable, mechanical fastening surface. The mechanics of interengagement of the fastening surface of FIG. 2 with an identical fastening surface are schematically illustrated in FIGS. 4*a*–4*d*, showing the connection of the first fastening surface 15 of the strap 10 with the second fastening surface 16. As shown in FIG. 4*a*, the taller ribs 19*a* contact one another first during interengagement of the fastening surfaces 15 and 16; and as shown by the arrow 25, the heads of the taller ribs tend to move into the gaps caused by the shortness of the adjacent shorter ribs 19*b*. This self-aligning of the mating fastening surfaces helps assure an easy and effective interengagement. Upon further pressure on the fastening surfaces, as shown in FIGS. 4*b* and 4*c*, the taller ribs 19*a* are directed by their contact with the adjacent shorter ribs 19*b* (see the arrow 26 of FIG. 4*b*) into a position where a flange 23 of a tall rib 19*a* of the fastening surface 15 slides under a flange 23 of a tall rib 19*a* of the fastening surface 16. Upon further pressure on the fastening surfaces, as shown in FIG. 4*d*, a flange 22 of a tall rib 19*a* of the fastening surface 15 moves under a flange 22 of a short rib 19*b* of the fastening surface 16.

The space 20 (see FIG. 2) between the stems of adjacent ribs accommodates the width 24 of a rib (the transverse distance parallel to the base sheet extending between the opposite outer or lateral edges of the flanges 22 and 23). Flanges in typical fasteners of the invention undergo little if any deformation during engagement, and in that case the space 20 between stems is generally equal to or greater than the width 24 of the ribs. However, the gap between ribs, i.e., the space 27 between facing flanges in FIG. 2, accommodates the width or thickness of the stem portion, but is less than the width 24 of a rib. Some flexing of the flanges toward the base sheet may assist accommodation of a rib being interengaged between two ribs of a mating fastener, though generally such flexing is not required. If the flanges flex, the spacing 20 may be less than the width 24, but that is not preferred.

The described movement of the head portion of the tall ribs 19*a* during interengagement occurs unimpeded because there is no structure of equal height adjacent the tall ribs. The lowest-force interengagement is obtained when tall and short ribs alternate with one another one-by-one; but still-desirable, somewhat higher, interengagement forces can be obtained if a lesser ratio of short ribs is used so that some tall ribs are adjacent to one another. The differences in rib height cause a repeated deviation from the profile that would occur with a full population of identical symmetrical ribs, and reduce the force required to accomplish interengagement of the fasteners.

The difference in height between the tall rib 19*a* and short rib 19*b* may vary, but typically should not be so great as to prevent a significant number of tall and short ribs from having complete engagement, i.e., engagement involving the illustrated movement of the flanges of the tall ribs on one fastening surface of a fastener pair underneath the short ribs of the opposed fastening surface of the pair. The desired ratio of rib heights will be affected by a number of parameters such as material and thickness of the rib portions and shape of the ribs. Typically, the shorter ribs will be about one-third to two-thirds the height of the taller ribs. With some binding straps of the invention tall ribs on the order of one-and-one-half times the height of the short ribs has achieved preferred results.

Figure 5A:
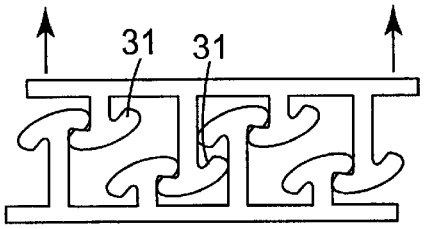
FIGS. 5*a*–5*b* are schematic side views of two fastening surfaces of the binding strap of FIGS. 1–3 undergoing disengagement.
Figure 5B:
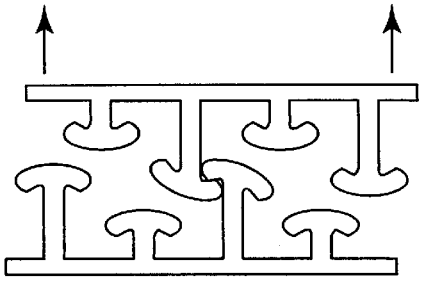

FIGS. 5*a* and 5*b* schematically show the steps of tensile-type disengagement of the fastening surface pair shown in FIG. 4. As shown, during such disengagement the heads 31 of the ribs tend to twist. They twist in one direction during a first stage of disengagement, and they twist in the opposite direction during a second stage of disengagement. This twisting action involves a bending action of the stem that may be different from the movement of the stem during engagement (twisting of the head portion may also occur during engagement). The degree of downward angling of the flanges and the stiffness or resistance to flexing of the flanges affects the degree of twisting required for the heads of the ribs to be freed from engagement with one another. The tensile disengagement illustrated in FIGS. 5*a* and 5*b* (a similar twisting-head disengagement can occur with other binding straps of the invention) can result in the tensile disengagement force being higher than the compressive engagement force because of the different and more extreme flexing of the stem portion that occurs during disengagement.

Figure 6:
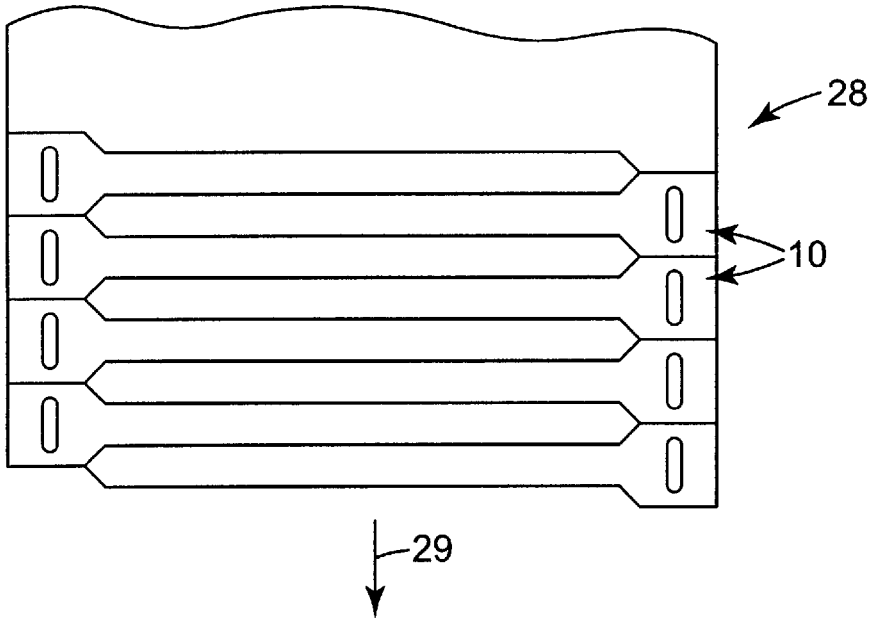
FIG. 6 is a plan view of a part of an extruded polymeric web from which binding straps of the invention may be cut.

Binding straps of the invention are preferably formed by first extruding a polymeric web through a die having an opening designed to generate a desired cross-sectional shape or profile and then cutting the web into straps of a desired shape. FIG. 6 illustrates such a profile-extruded polymeric web 28 and a pattern of binding straps 10 as cut from the web. Profile extrusion is a preferred, low-cost technique for forming parallel ribs as used in binding straps of the invention, with the ribs extending parallel to the machine direction of extrusion (direction of the arrow 29). Most binding straps are cut transversely from the extruded web as shown in FIG. 6; this causes the ribs to be transverse to the length of the strap, which is advantageous because the highest resistance to a shearing separation of engaged fastening surfaces of binding straps of the invention is generally obtained with such a construction. However, useful interengagements can be obtained when the ribs are parallel to the length of the strap, and such a construction allows for very long straps or wound rolls of stock from which straps can be cut in automated binding operations. Long straps having ribs transverse to the length of the strap can be prepared by extruding the material of the strap through an annular die and spirally cutting the resulting annular extrudate. Although the ribs are not exactly at 90 degrees to the length of such a spirally cut strap, the ribs are regarded herein as transverse to the strap length.

Figure 7:
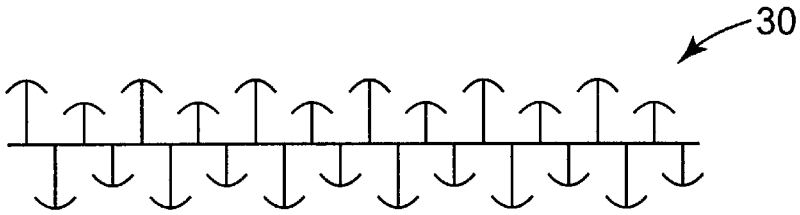
FIGS. 7 and 8 are schematic side views of different binding straps of the invention.
Figure 8:
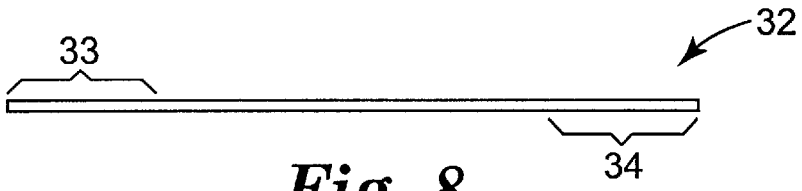

Binding straps of the invention may be formed without a head portion or opening such as the head portion 12 and opening 13 shown in FIG. 1 and may be of uniform construction from end to end. Also, a fastening surface may be provided over the full length of a binding strap or only at separated portions that will be overlapped during a binding use. Also, a fastening surface or separated fastening surfaces may be provided on each side of a binding strap of the invention. Dual-sided binding straps of the invention, having a construction as illustrated in FIG. 7, are desirable for many uses. The strap 30 shown in part in FIG. 7 includes a pattern of ribs on one major side of the strap and an identical pattern on the opposite major side of the strap. The ribs need not be aligned, as shown in FIG. 7, nor need there be coextensive fastening surfaces on each side of the strap, i.e., the fastening surfaces on the opposed sides of the strap may be at separated portions of the strap. For example, as shown by the strap 32 in FIG. 8, a fastening surface 33 may be on one side at one end of the strap and a fastening surface 34 may be on the opposite side at the other end of the strap.

Fastening surfaces may also be provided on opposite sides of a strap by folding a strap having a fastening surface on only one side and a smooth surface on the other side. The strap may be folded, smooth side to smooth side, and the folded parts adhered together, e.g., with an adhesive layer or sheet interposed between the folded portions, by heat welding, etc. One advantage of such a folded-over construction is that it provides reinforcement, which is especially useful around the opening of a head portion, for example. In some cases only an end of the strap is folded to provide a sort of tab at one end which may be fastened to another strap portion against which it is overlaid and pressed. Or a longer length may be folded to provide a longer fastening surface that may be engaged with a longer length of fastening surface or at a variety of different fastening positions.

Figure 9A:
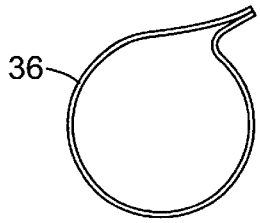
FIGS. 9*a*–9*e*, 10*a*–10*b*, 11, 12, 13*a*–13*f*, 14*a*–14*b*, and 15*a*–15*d* are schematic diagrams showing various binding straps of the invention and their use.
Figure 9B:
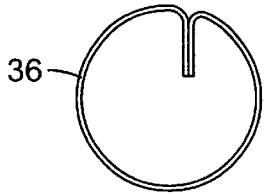
Figure 9C:
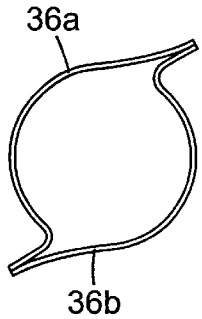
Figure 9D:
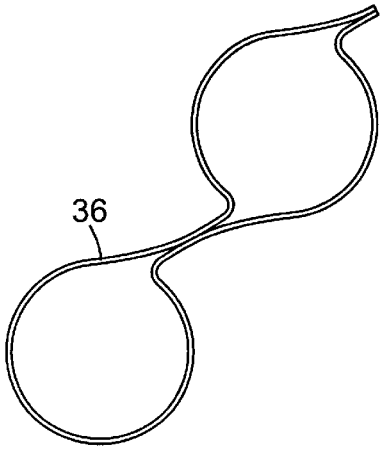
Figure 9E:
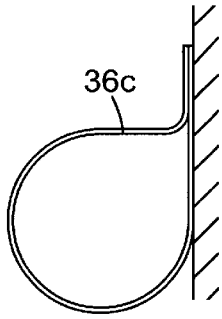

FIGS. 9*a*–9*e* illustrate some of the various ways in which a binding strap 36 having a fastening surface (or separated fastening surfaces) on one side may be looped around an article or articles, and the ends or other portions of the strap fastened together. To allow looping as illustrated, a binding strap of the invention generally is substantially longer than it is wide, e.g., generally at least 5 times longer than wide, and more commonly at least 10 times as long as wide (width being measured on the narrowest portion of the strap). Depending on intended use, a binding strap is often about one centimeter or less in width, and sometimes 5 or 6 millimeters or less in width; though it can also have a larger width. In FIG. 9*a* the fastening surface(s) of the binding strap 36 face inwardly, toward the article(s) being bound, and the opposite ends of the inner side of the binding strap are connected together. In FIG. 9*b* the fastening surfaces face outwardly, so the inner surface contacting the article(s) being bound may be smooth. In FIG. 9*c* two separate binding straps 36*a* and 36*b*, which may be cut from a single length of material, form the binding loop and are fastened at both ends. In FIG. 9*d* a single binding strap 36 is connected at its ends as well as at an intermediate portion (or, if desired, at more than one intermediate position) so as to form multiple loops in which an article(s) may be bound. In FIG. 9*e* the exterior surface of the binding strap 36*c* can be smooth, adapting it to carry an adhesive or to be pressed against an adhesive surface and thereby attach a bound article(s) to a wall or other substrate.

Figure 10A:
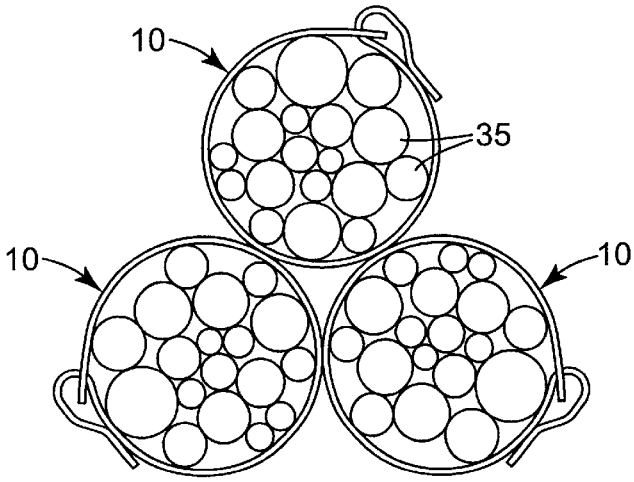
Figure 10B:
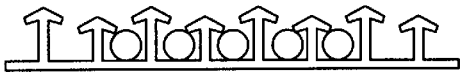

FIG. 10*a* shows an assembly of bundled wires, cables or other articles 35 assembled through use of a binding strap having a fastening surface on its exterior surface (the interior surface can be smooth or have a fastening surface depending on the intended method for fastening an individual binding strap together). The bundles are first formed, e.g., with a binding strap 10 such as described in FIGS. 1–3, whereupon adjacent bundles of articles are fastened together through interengagement of the fastening surfaces on the exterior of the individual binding straps 10. Instead of fastening individual bundles together, they may be fastened to a substrate provided with a binding strap or other fastening surface. As shown in FIG. 10*b* articles being bound, such as small-diameter wires, may fit between ribs which can provide organization to a collection of wires.

Figure 11:
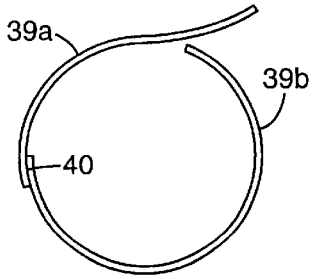

In FIG. 11 two straps 39*a* and 39*b*, which may be the cut parts of a single strap, are used to form a loop. Each strap 39*a* and 39*b* may carry a fastening surface only on one side, but by reversing the straps so that the fastening surface of one faces the fastening surface of the other, the binding straps may be fastened together to form a loop. If desired, the straps may be sealed, e.g., with heat, at the point 40. Alternatively, a strap may be extruded with fastening surfaces in limited areas on opposite sides of the strap to obtain a strap with fastening surfaces such as obtained by joining straps 39*a* and 39*b*. In another technique a single strap having a fastening surface on only one major side is twisted so that the fastening surfaces on the opposite ends of the strap face one another.

Figure 12:
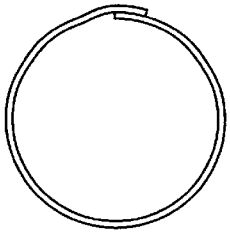
Figure 13A:
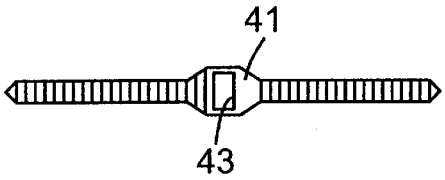
Figure 13B:
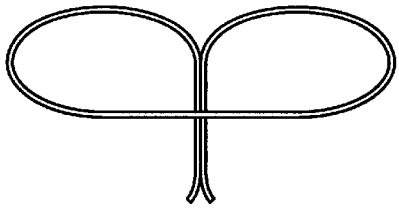
Figure 13C:
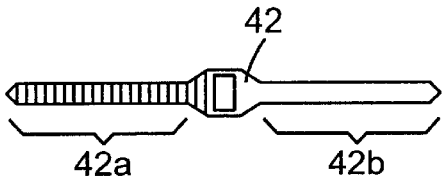
Figure 13D:
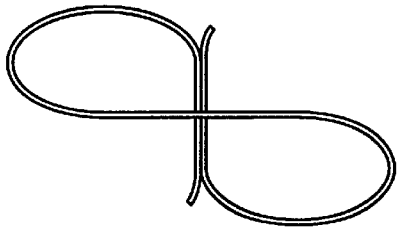
Figure 13E:
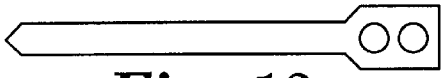
Figure 13F:
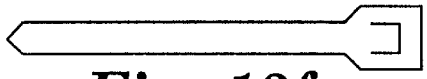

FIG. 12 pictures a loop prepared with a double-sided binding strap, i.e., a strap having fastening surfaces on opposite sides of the strap. Such a strap allows formation of a loop without twisting the strap or cutting the strap into two parts, or without use of an opening in the strap.

The straps 41 and 42 pictured in FIG. 13 illustrate that an opening may be formed at places other than the end of the strap. The strap 41 in FIGS. 13*a* and 13*b* has a fastening surface on the side exterior to the loops; it could also have a fastening surface on the opposed side in which case the ends of the strap could be folded over against the portions of the strap adjacent the opening 43. The strap 42 in FIGS. 13*c* and 13*d* has a fastening surface over one portion 42*a* of its length on the opposite side of the strap from the length 42*b*. Binding straps of the invention may have more than one opening, e.g., plural openings can be in the head portion of a strap or at other locations along the strap length as illustrated in FIG. 13*e*. Also, instead of an uncovered opening, one or more flaps may extend into or cover part or essentially all of the opening, as illustrated in FIG. 13*f*.

Figure 14A:
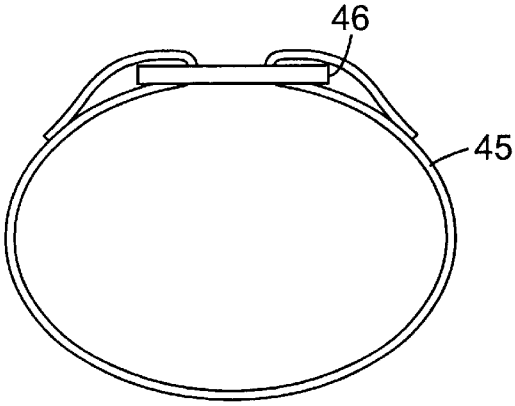

As shown in FIG. 14, binding straps of the invention may be used with another structural member to complete a loop. In FIG. 14*a* a binding strap of the invention 45 is used with a separate ring 46, e.g., of metal or molded plastic. Opposed ends of the strap 45 are threaded through the ring 46 and folded back upon themselves and fastened together by means of a fastening surface(s) on the exterior of the strap.

Figure 14B:
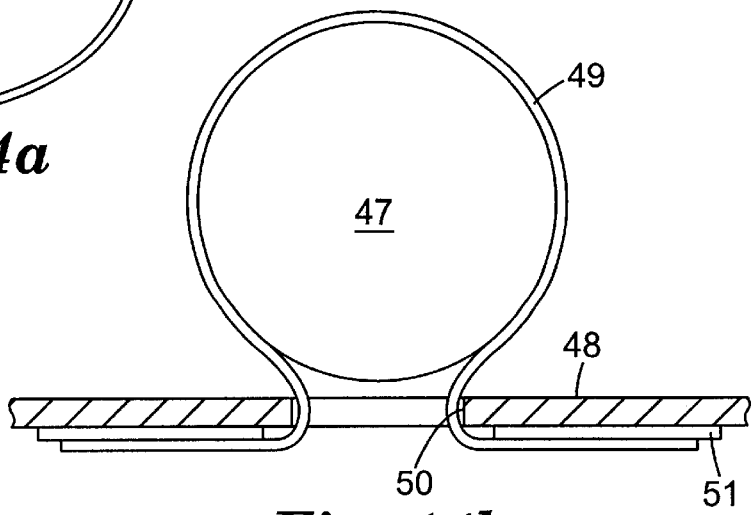

In FIG. 14*b* an object 47 (e.g., the wheel of a toy car) is attached to a flat panel 48 (e.g., a cardboard sheet) by use of a binding strap 49. The opposed ends of the strap are inserted through an opening 50 in the panel 48 and the ends fastened to additional fastening surfaces of the invention 51 that have been attached to the bottom side of the panel. The panel may be curved or have some special shape other than flat. Also, in other embodiments of the invention, the panel includes more than one opening, e.g., smaller openings to better maintain the strength of the panel. When the panel includes such a multi-opening apertured area, one strap end may be inserted through one opening and another strap end may be inserted through the other opening.

In other cases, the further structural member used with a binding strap of the invention may occupy a large portion of the circumference around a bound article. For example, binding straps of the invention may be used with garment parts, including diapers, with separate strap portions or ring members or openings on or in the garment part by which fastening is achieved. Whether with an arrangement as shown in FIG. 14*a* or 14*b*, or as shown in FIG. 1*a* or 1*b*, or in some other arrangement, one advantage of the invention is that a strap may be drawn tightly to provide a kind of cinching action on an article or articles, and then fastened in the cinched position.

Figure 15A:
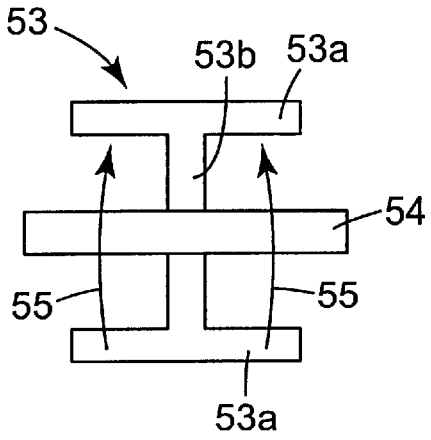
Figure 15B:
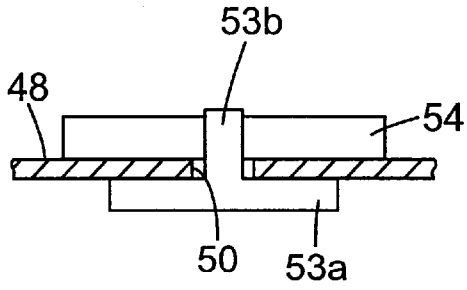

Binding straps of the invention may include additional structure in addition to an elongated strap portion. For example, as illustrated in FIG. 15, which shows a binding strap of the invention 53 in plan view laid underneath an object 54, the strap may include transverse end pieces 53*a* which are brought into contact with one another when the strap is folded around the object 54 in the manner represented by the arrows 55. The folded strap is held in the folded position by a fastening surface according to the invention which may be carried on the main strap portion 53*b* or the transverse end pieces 53*a* or both. After the strap has been folded around the object and fastened together, the transverse end pieces may be inserted through an opening in a panel to hold the object 54 against the panel, as shown in FIG. 15*b*.

Figure 15C:
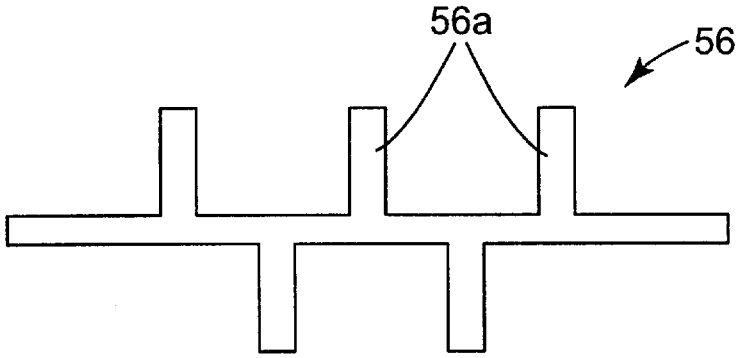
Figure 15D:
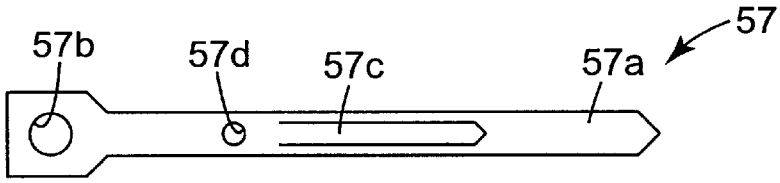

FIG. 15*c* shows a different embodiment of binding strap 56 having side straps 56*a* that may be wrapped, for example, around different objects, a single long object or bundle of objects, a pair of side-by-side long objects, etc. FIG. 15*d* shows a binding strap 57 which has a first elongate strap portion 57*a* that may be wrapped around one article or bundle of articles and fastened using the opening 57*b*; and a second elongate strap portion 57*c* that may be wrapped around a second article or bundle of articles and fastened using the opening 57*d*.

Figure 16:
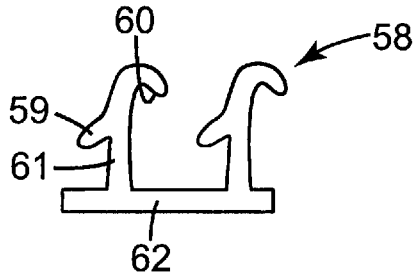
FIGS. 16, 17, 18*a*–18*b*, 19*a*–19*j*, and 20 are enlarged schematic side views of the ribs from a variety of binding straps of the invention.

Although the ribbed fastening surface illustrated in FIGS. 1–5 is preferred, binding straps of the invention may use other fastening surfaces also. Some such alternative fastening surfaces are illustrated in parent, copending application Ser. No. 09/501,900, filed Feb. 10, 2000. Some of the different configurations for the ribs are illustrated in FIGS. 16–19. FIG. 16 illustrates a rib structure in which flanges 59 and 60 on opposite sides of the stem portion 61 are spaced at different heights from the base sheet 62. The difference between the flanges 59 and 60 as to their height of attachment to the stem portion 61 makes the ribs 58 asymmetric about a central vertical plane. Such an asymmetry aids the self-mating interengagement of binding straps of the invention, in that flexing of the stem portion and associated movement of the top of the rib occurs unimpeded, in contrast to the situation that would exist with symmetrical ribs, e.g., ribs that have identical flanges attached to the stem portion at the same height on each side of the stem portion. The asymmetry of flange height causes a repeated deviation from the profile that would occur with a full population of identical symmetrical ribs, and reduces the force required to accomplish interengagement of the fasteners.

Figure 17:
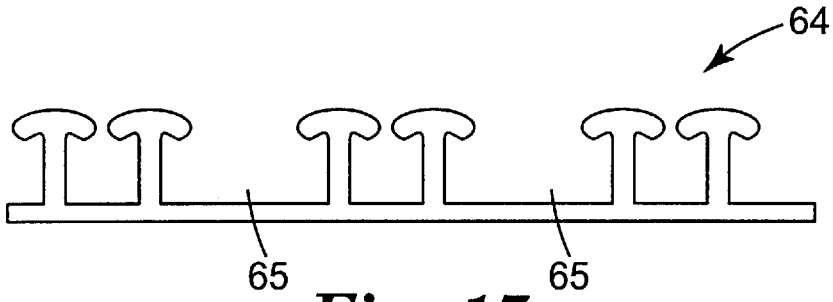

FIG. 17 illustrates a fastening surface 64 from which a row of ribs is omitted periodically across the width of the fastening surface to leave a space 65. Such a repeated deviation of the rib profile from the profile of a full population of equally spaced symmetrical ribs reduces interengagement force because ribs are unimpeded during flexure into omitted-row spaces adjacent the flexing ribs. Omission of a row typically occurs with every third, fourth or fifth row. Omission of every third row typically provides the highest ratio of disengagement to engagement forces, but may require careful alignment of fastening surfaces in a fastening surface pair to assure a desired maximum disengagement force (with closely spaced ribs on one fastening surface always filled with ribs from the opposed fastening surface).

Figure 18A:
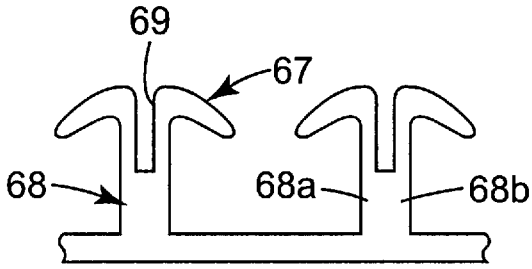
Figure 18B:
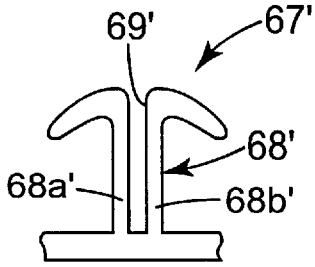

FIGS. 18*a* and 18*b* illustrate the structure of ribs 67 (67' in FIG. 18*b*) useful in different fastening surfaces of the invention in which the stem 68 (68') of the rib has a substantially vertical (i.e., substantially perpendicular to the base sheet) slot 69 (69') extending from the top through part (FIG. 18*a*) or the full height (FIG. 18*b*) of the stem. Note that although the slot 69' in FIG. 18*b* essentially divides the stem 68' into two halves 68*a*' and 68*b*', the two halves function together as one part. The divided stem 68', as well as the divided rib 67', are regarded as one part herein, albeit, a divided part. Upon interengagement of a fastening surface pair using the type fastening surface illustrated in FIG. 18, the stem halves 68*a* and 68*b* (68*a*' and 68*b*') created by the slot 69 (69') flex toward one another to assist the flanges in moving past, and engaging underneath, flanges of the ribs on the opposed fastening surfaces.

Figure 19A:
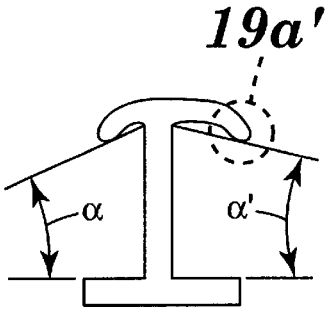
Figure 19A:
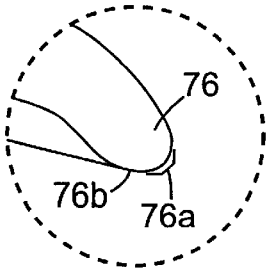
Figure 19B:
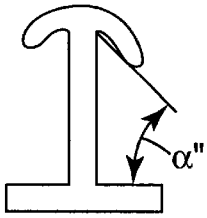
Figure 19C:
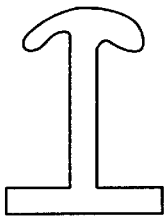
Figure 19D:
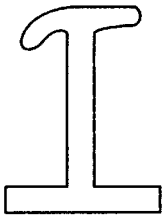
Figure 19E:
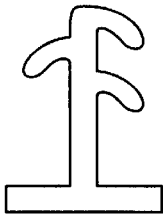
Figure 19F:
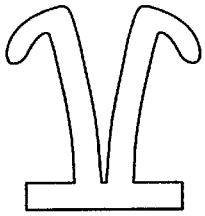
Figure 19G:
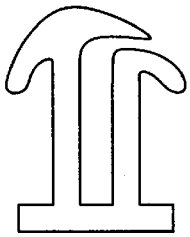
Figure 19H:
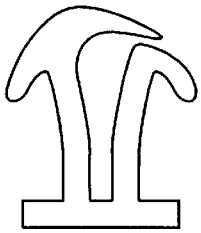
Figure 19I:
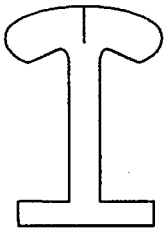

FIGS. 19*a*–19*j* illustrate additional rib shapes for fasteners of the invention. In FIGS. 19*a* and 19*b* one flange is wider than the other flange and/or is angled toward the base sheet at an angle ($\alpha'$, $\alpha''$) different from the angling of the other flange ($\alpha$). In FIG. 19*c* one flange is thicker than the other flange. In FIG. 19*d* one flange curves toward the base sheet while the other flange is substantially parallel to the base sheet. In FIG. 19*e* two flanges are attached to one side of the stem portion and only one flange is attached to the other side. In FIG. 19*f* the slot in the rib is wider at the top and narrows toward the bottom. In FIGS. 19*g* and 19*h* a protective flange at the top of the rib covers a slot in the rib, thereby assuring that mating fasteners will not become misaligned by entry of a rib part of one fastener, for example, a rib half 68*a*' or 68*b*' pictured in FIG. 18, within the slot between rib halves of the other fastener. The rib in FIG. 19*i* is divided, in that a slit or cut is formed, either during extrusion or by a cutting tool after extrusion, in the top of the rib. Because of this slit, the stem flexes more readily to allow movement of the flanges toward the stem during interengagement of the fastener with a mating fastener, thereby achieving a narrower rib width that facilitates the interengagement process. Upon disengagement of a fastener pair, the flanges are limited in a reverse or disengaging movement by abutment of the divided parts at the slit.

Figure 19J:
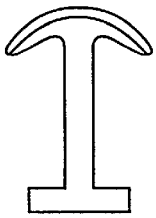

The rib in FIG. 19*j* is a representative coextruded rib, which in this case includes two different materials, one constituting the principal portion of the rib and the other constituting a top portion of the rib. More than two materials may be extruded and may constitute different portions of a rib or base sheet. For example, the base sheet might comprise one material, e.g., for flexibility or suppleness, and the ribs comprise a different material, e.g., a stiffer material. Or the stem portion of a rib may comprise one material, e.g., having flexibility, elasticity, or fatigue-resistant properties desired for repeated flexing, and the head portion, i.e., the top portion of the rib including the flanges, may comprise a different material, e.g., a stiffer, non-flexing material.

The fastening surfaces of binding straps of the invention may include combinations of features such as those discussed above. For example, such fastening surfaces may include ribs of the shape illustrated in FIG. 16, 18 or 19 in a tall-short pattern as illustrated in FIG. 2 or in an omitted-row pattern as illustrated in FIG. 17. When a combination of features is used, the profile formed by the ribs may have more than one regularly repeated deviation in the direction transverse to the length of the ribs from the profile that would be formed by a full population of equally spaced, identical, undivided, symmetric ribs. ("Full population" means that each potential rib site is occupied, so that ribs cover the intended functional surface of the base sheet—the surface where fastening or engaging is to occur—at a uniform spacing that will achieve interengagement with the ribs of an identical mating fastening surface.) The asymmetries or profile-deviation features discussed above are illustrative only and are not exhaustive. Profile features may be selected from a variety of features including, as examples only, non-identity of ribs (e.g., some ribs in a regularly repeated pattern being different from other ribs in cross-sectional shape, such as different in rib height, or different in flange shape or flange dimensions), asymmetry of rib shape (e.g., at least some ribs in a regularly repeated pattern being asymmetric in shape about a central vertical plane through the rib), inequality of rib spacing (e.g., the spacing between some ribs being different in a regularly repeated pattern from the spacing between other ribs), and dividing of ribs (e.g., at least some ribs in a regularly repeated pattern having an elongated opening such as a slot, e.g., as in FIG. 18, or slit, e.g., as in FIG. 19*i*, extending generally from the top of the rib at least partially through the height of the rib toward the base sheet).

Figure 20:
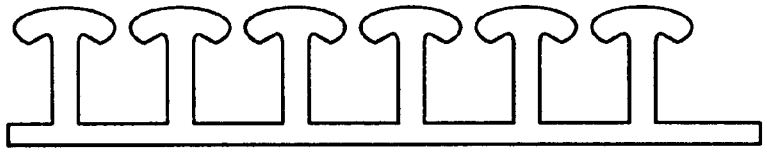

Although a variation in rib height or some other transverse profile deviation is strongly preferred, the advantages of binding straps or fasteners having others of the features described herein could also be realized to a lesser degree with fastening surfaces having no variation in rib height or other transverse profile deviation, for example, with a fastening surface as illustrated in FIG. 20. Narrower strap widths, e.g., about one centimeter or less, and preferably about 5 or 6 millimeters or less, are desired for straps or fasteners in which ribs are symmetrical and identical in height, shape, and spacing, as shown in FIG. 20, for one reason, because engagement forces are less with such widths. Such a reduction in engagement force is especially helpful when binding straps or fasteners as illustrated in FIG. 20 are mated with themselves.

The ribs in a fastening surface of a binding strap of the invention, such as the ribs 19 in FIGS. 2 and 3, are often continuous over their length (the dimension 70 in FIG. 3), but they can be interrupted, as by cutting after extrusion. Such interruptions can facilitate flexibility of a binding strap or fastening surface about an axis transverse to the length of the ribs. Optionally the base sheet may be stretched after cutting the ribs to form a space between the adjacent ends of the interrupted ribs (illustrated, for example, by the dotted lines 71 in FIG. 3). In addition, interruptions prepared by pressure on an extruded web, for example, with a hot wheel, can make the base sheet thicker in the area of the interruption (thickened with the material of the ribs which has flowed under pressure of the hot wheel) and these thicker regions can be desirable for sewing of the fastener to a fabric or other substrate. Also, such thickened regions may be used to provide a barrier to relative sliding movement between mating fastening surfaces.

By definition, a rib has length, i.e., it is longer than it (or, more precisely, its stem) is wide. Almost always, the ribs are at least 10 times longer than the width of the stem portion, and more typically they are at least 50 or 100 times longer than the width of the stem portion (in some binding straps of the invention having ribs transverse to the length of the strap, the strap width limits the length of even uninterrupted ribs, for example, to less than 50 or 100 times stem width). However, the ribs will generally function as desired (e.g., bend more readily in the direction of their width rather than their length even when there is longitudinal spacing between ribs) if their length is at least 3 to 5 times the width of their stem portion. When there is little if any longitudinal spacing between ribs, cuts may occur in the ribs at a closer spacing, in which case the cut sections may combine to comprise one rib rather than each cut section functioning as a separate rib.

The length of the ribs and any longitudinal spacing between them are chosen to assure that the ribs will interengage with the ribs of a mating fastening surface to hold the fastening surfaces together. Longitudinal spacing between ribs seldom averages more than one-half the average length of the ribs, and more typically averages less than one-tenth the average length of the ribs. Interruptions of the rib are not regarded as altering the rib profile of the fastening surface over its length.

The size of the ribs may be varied for different applications. Binding straps of the invention will generally function as desired through a range of rib sizes. Depending on composition and rib shape, larger rib sizes often involve larger engagement and disengagement forces than smaller rib sizes. Larger rib sizes may be used for heavy-duty applications, where a pair of fastening surfaces may be intended to stay engaged longer and/or resist greater disengagement forces; while smaller sizes may be appropriate for lighter-duty applications. The bulk of applications will generally call for a rib height between about 0.25 mm and 3–5 mm. For some applications, ribs on the order of one or two millimeters or less in height may be preferred. Depending on rib size, ten or more ribs of a fastening surface are usually interengaged with ribs of another fastening surface in a mated pair, and more often twenty or more are interengaged.

As illustrated in the drawings, the height of a stem portion (the dimensions 72 for the tall rib 19*a* in FIG. 4*b* and 73 for the short rib 19*b*) is preferably greater than the width of a flange (the dimension 74 in FIG. 4*a*) attached to the stem portion. The result (assuming the same thickness and composition for stem and flange) is that the stem portion will tend to flex in preference to flexure of the flanges under the pressure placed on the ribs during interengagement with the ribs of an opposed fastener of a fastener pair. Bending stiffness is generally proportional to $W(T/L)^3$ for a long beam of length L, width W, and thickness T, when bending occurs in the thickness direction. Because the stem is typically longer than the flanges are wide, flexing occurs more easily in the stem if the flanges and stem have similar thicknesses and composition. The ease of flexing in both stem and flanges can be controlled by choice of structure, dimensions and modulus of elasticity of the material of the stem and of the flanges. Desirably, the flanges have a substantial thickness over most of their width (the dimension 74 or 74*a* in FIG. 4*a*) to limit flexing of the flanges and to maintain high disengagement forces. For best results, a flange is at least about three-quarters as thick as the stem over at least three-quarters to nine-tenths or more of its width. Preferably, a flange is about the same thickness as the stem.

The described deformation of the stem portion during interconnection with an identical fastening surface in preference to deformation of the flanges attached to the stem portion offers important advantages in fastening and holding together fastening surfaces on binding straps of the invention. "Deformation of the flanges" primarily refers to a flexing of the flange about some axis intermediate the edge of the flange and the stem portion, though flexing of the flange near or at its point of connection to the stem potion is also undesired (as opposed to flexing of the stem portion that allows individual movement of a flange; the latter can be desired and encouraged as illustrated by the structure of FIG. 19*i*). Flexing of the flange about an intermediate axis indicates a relative weakness of the flange (achieved for example by making the flange thinner than the stem portion), which results in an undesirable lessening of the force required to disengage interconnected fastening surfaces. Flexure of stems is also considered preferable to flexure of flanges, because repeated flexure of flanges during repeated closing and opening cycles may lead to permanent deformation of the flanges.

Whether deformation occurs in stems alone, or in flanges alone, or in both stems and flanges, the ribs are regarded as deformable herein. The deformation that occurs in either stem or flanges is desirably elastic, so that the stem and flange return substantially to their previous shape and position after deformation. For single-use binding straps or fasteners, permanent deformation of the ribs (e.g., by a pivoting of the flange about its point of connection to the stem portion such that the elastic limit of the polymer is exceeded at the pivot point, or less preferably, flexure of the flange about an intermediate axis) may occur during disengagement; but even in such binding straps, any deformation during engagement should be primarily temporary or elastic. Generally, the stems should be perpendicular, or nearly perpendicular, to the base sheet to assure that the stems flex as desired, especially during engagement, and do not become pushed over without interengaging with the ribs of a mating fastening surface.

For many applications, the lower the force required to achieve engagement while maintaining other desired properties, the better. In contrast to the desire for a lower engagement force, it is generally desired that the disengagement force be high, i.e., higher than what was perceived as the engagement force. Disengagement forces will vary depending on the kind of support that is provided to the fastening surface. Thus, a fastening surface carried on a binding strap of the invention that is attached to a rigid substrate will generally experience tensile-type disengagement forces acting perpendicular to the plane of the binding strap or shear or cleavage forces acting parallel to the binding strap, and will experience little if any peel-type forces. On the other hand, a binding strap of the invention attached to a flexible substrate will experience peel-type forces in addition to tensile and shear forces. An important advantage provided by fastening surfaces on preferred binding straps of the invention is an improvement in resistance to peel forces. Binding straps of the invention may be drawn tightly around an article or articles being bound and fastened in place, and the interconnection will hold despite the forces tending to separate the fastening surfaces, which includes peeling type forces.

Figure 21:
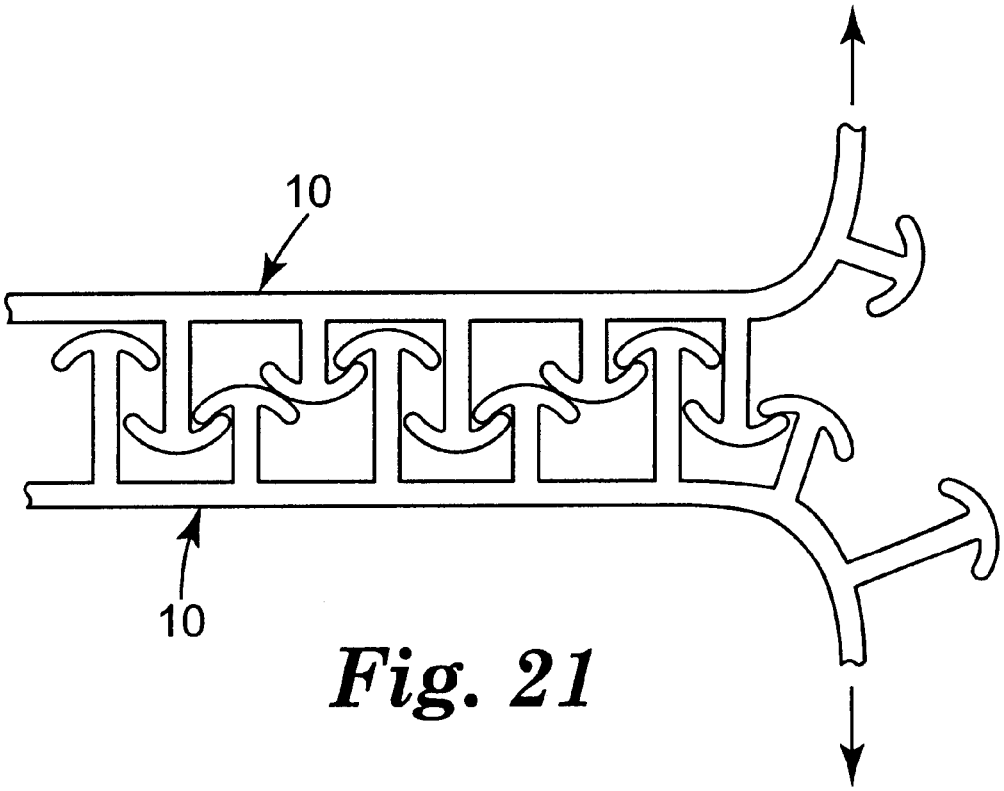
FIG. 21 is an enlarged schematic diagram of engaged fastening surfaces as shown in FIG. 2 undergoing peeling type disengagement.

FIG. 21 schematically illustrates the movement that the ribs of a fastening surface as shown in FIGS. 2 and 3 undergo during peeling disengagement. The drawings help illustrate how the downwardly angled nature of the flanges increases the force required to separate the binding straps or fasteners during peeling disengagement. That is, because of the angling down, the flanges remain engaged for a longer time before separating during peeling type disengagement than they would if there were no angling downward. Resistance to peel-type disengagement is further aided because the flanges in binding straps of the invention desirably have a substantial thickness over most of their width. Resistance to flexure by the flanges increases the forces required for disengagement. Preferably the stem portions deform in preference to the flanges during peel-type disengagement.

While resistance to peel-type forces is useful in binding strap uses, it is also useful in fasteners, especially those applied to flexible substrates such as wearing apparel, including diapers. Fasteners having a structure as used in the binding straps of the invention are understood to be unique and to offer benefits over prior-art fasteners. That is, a fastener is understood to be unique that comprises a base sheet and an array of parallel, narrowly spaced, elastically deformable ribs projecting integrally from the base sheet; the ribs comprising a base stem portion attached to and substantially upright from the base sheet and a flange attached to at least one side of the stem portion and spaced from the base sheet; the underside surface of outer portions of at least some flanges projecting downwardly toward the base sheet; the array of ribs establishing a first fastening surface that can be pressed against and thereby interconnected with an identical fastening surface; and at least some flanges having a substantial thickness over most of their width, as discussed above such that the stem portion deforms in preference to the flange during peel-type disengagement from an identical fastening surface.

The improved resistance to disengagement caused by angling of the flanges is a strong reason for using such angling. In addition, angling downward of a constant-thickness flange gives the top surface of the rib an arrowhead or tapered shape (e.g., the width of the top portion or head of the rib gradually increases from its width at the top toward the base sheet), which assists the rib to move between adjacent ribs of a mating fastener during engagement and thus reduces engagement force. The degree of angling (for example, as indicated by the angle $\alpha$ illustrated in FIGS. 2 and 19*a* and 19*b* between the flange and the plane of the base sheet) is not always easily or exactly measured, for example, because the flange may have a curved shape. In general, downward angling of an outer portion of the flange, and more specifically downward angling of the underside surface of the outer portion, is important in contributing to higher disengagement forces. By downward angling, it is meant that, from a point closer to the stem to a point further from the stem, the outer underside surface portion is directed on a path of intersection toward the base sheet. The underside surface of the outer portion of the flange projects downwardly toward the base sheet; thus the underside surface of the outer portion of the flange is closer to the base sheet than are some more inwardly portions of the underside surface.

Note that "outer" or "outer portion" in the above discussion means generally outer and does not necessarily mean "outermost" or "outermost portion." For example, FIG. 19*a*' pictures in enlarged detail the outer portion 76 of a flange, and shows that even though the outermost underside surface portion 76*a* of the flange may curve upwardly from the bottommost point 76*b* of the flange underside surface, the generally outer portion 76, which constitutes the bulk of the flange portion that moves past a flange during disengagement, curves downwardly. Note also that a flange may curve upwardly from its attachment to the stem portion, in which case portions of the underside surface nearest to the stem may be closer to the base sheet than some underside surface portions further removed from the stem. But at the outer portion of the flange, the underside surface is closer to the base sheet than are some more inwardly underside surface portions. The result is that upon interengagement of a mating pair of fastening surfaces on binding straps of the invention, edge-portions of interengaged flanges nestle into the space between the flange and the stem portion. The flanges are thus further interconnected in that the flanges have an engaging interference in directions parallel to the base sheet.

The desired degree of angling will vary with the intended application for the fastening surface, the width of the rib, and the shape, composition and properties of other parts of the rib and binding strap, among other factors. Most flanges are angled at least 5 degrees and for many applications are angled at least 20 degrees. The angle of interest may be regarded as the angle between the plane of the base sheet and a line segment that, in most cases extends from the lower edge of the point or area of attachment of the flange to the stem through the bottommost point on the underside of the outer portion of the flange, i.e., the point on the outer portion of the flange closest to the base sheet. If the flange curves upwardly from its point of attachment to the stem portion, so a point on the underside of the flange is higher (spaced further from the base sheet) than the lower edge of the point of attachment, the defining line segment extends from that higher point through the noted bottommost point on the underside of the outer portion of the flange.

In some embodiments of the invention a friction-reducing agent is incorporated into the ribs of a fastening surface, e.g., on the top rib surface to enhance relative movement during the initial interengagement of a pair of fastening surfaces. Such friction-reducing agents, for example silicone materials, also may have the advantage that they help molten polymeric material flow during extrusion or other forming of the fastener body and thus assist the material to fill out the desired rib shape.

Binding straps of the invention may be made from a variety of materials but most commonly are made from polymeric materials, using generally any polymer that can be melt processed. Homopolymers, copolymers and blends of polymers are useful, and may contain a variety of additives. Inorganic materials such as metals may also be used. The composition is chosen to provide desired bending characteristics, including usually an elastic bending movement of the stem of the rib in a direction lateral to the length of the rib and little if any bending of the flanges during engagement and disengagement. Generally a modulus of from $10^3$ MPa to $10^7$ MPa for the composition of the fastener including any additives is satisfactory but this may change depending on the application.

Suitable thermoplastic polymers include, for example, polyolefins such as polypropylene or polyethylene, polystyrene, polycarbonate, polymethyl methacrylate, ethylene vinyl acetate copolymers, acrylate-modified ethylene vinyl acetate polymers, ethylene acrylic acid copolymers, nylon, polyvinylchloride, and engineering polymers such as polyketones or polymethylpentanes. Elastomers include, for example, natural or synthetic rubber, styrene block copolymers containing isoprene, butadiene, or ethylene (butylene) blocks, metallocene-catalyzed polyolefins, polyurethanes, and polydiorganosiloxanes. Mixtures of the polymers and/or elastomers may also be used.

Suitable additives include, for example, plasticizers, tackifiers, fillers, colorants, ultraviolet light stabilizers, flame retardants, antioxidants, processing aids (urethanes, silicones, fluoropolymers, etc.), low-coefficient-of-friction materials (silicones), electrically or thermally conductive fillers, magnetic fillers, pigments, and combinations thereof. Binding straps of the invention may be opaque and have a color, or they may be essentially clear to allow viewing of material under the strap. Generally, additives can be present in amounts up to 50 percent by weight of the composition depending on the application. Multilayer extrusion may be used to segregate an additive such as a flame retardant into only one or more layers of a binding strap of the invention.

Profile extrusion, e.g., extrusion of a polymeric web through a die having an opening cut (for example, by electron discharge machining) to generate a web with a desired cross-sectional shape or profile is the most preferred method of preparing binding straps of the invention. The web is generally quenched after leaving the die by pulling it through a quenching material such as water. A wetting agent may be required in the quenching medium to assure good wetting of the whole surface of the extruded web, including spaces between ribs. The extruded web may be further processed, e.g., by cutting extruded ribs as discussed above, and binding straps then formed, generally by cutting and slitting the extruded web as illustrated in FIG. 6. Tentering operations may also be performed, e.g., to strengthen the fastener. For fasteners in tape form in which the ribs run parallel to the length of the tape, machine-direction tentering is generally sufficient. For fasteners in tape form in which the ribs are transverse to the length of the tape, cross-direction tentering is used; and to achieve desired spacing or other properties, machine-direction tentering may be used in addition. After extrusion, fasteners are formed, generally by cutting and slitting the extruded web.

Figure 22:
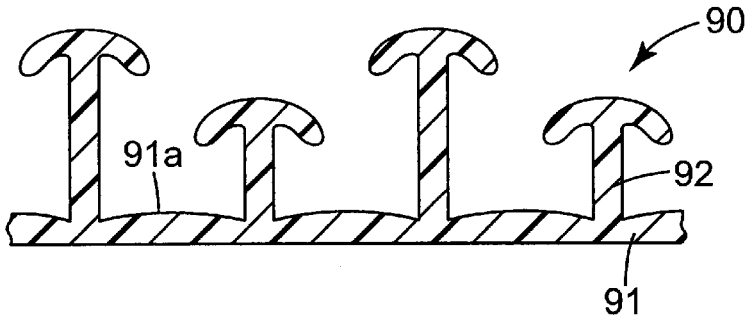
FIGS. 22 and 24 are sectional views through different binding straps of the invention.

The base sheet in fasteners of the invention is often flat (i.e., the spaces 20 in FIG. 2 between ribs are generally flat). But they can be configured. One example is the fastener 90 shown in FIG. 22, in which the base sheet 91 is thicker in the portions 91*a* between the ribs 92. Such increased thickness strengthens the fastener and also can increase opacity or color (e.g., whiteness) of the fastener. To profile-extrude fasteners with a base sheet such as shown in FIG. 22, the openings in the die where the portions 91*a* are formed may need to be larger than the dimension of the finished base sheet because of shrinkage of the extruded material before it solidifies. In fact, some upward curvature of the die opening like that shown in FIG. 22 may be used simply to assure that the base sheet is flat and sufficiently thick in the spaces between the ribs. Exaggerated die opening sizes are used to obtain the shape shown in FIG. 22.

Although extrusion is strongly preferred, binding straps of the invention can be prepared in other ways, for example, by injection molding or casting. Also, as previously stated, the body of a binding strap of the invention may include multiple layers, generally of different composition. Such multiple layers can be provided by coextrusion techniques (as described, for example, in published PCT Appln. No. WO 99/17630, published Apr. 15, 1999), which may involve passing different melt streams from different extruders into a multiple-manifold die or a multiple-layer feed block and a film die. The individual streams merge in the feed block and enter the die as a layered stack that flows out into layered sheets as the material leaves the die. A binding strap of the invention thus may have a base sheet of one composition and ribs of a different composition. Or a portion of the ribs, e.g., the top edge-portion of the rib as shown in FIG. 19*j*, may have a different composition from other portions of the rib. For example, the top portion of the rib may include a composition that forms a lower-friction surface than the rest of the rib.

In a different approach, one or more layers are laminated into the body of a fastener of the invention. In the illustrative apparatus of FIG. 23, a supplementary web 94 is unwound from a storage roll and laminated to a fastener web 95 shortly after it leaves an extruder 96. The just-extruded fastener web 95 is still sufficiently soft and tacky that the supplementary web 94 becomes adhered to the fastener web, generally on the side of the web opposite from the rib structure. The extruded and supplementary webs are desirably compatible, though techniques such as static pinning or coextrusion of a tie layer can be used to form a durable composite from somewhat incompatible materials. The assembly of extruded and supplementary webs can be passed into a cooling bath 97, e.g., of water, and optionally passed over a roll 98, which holds the supplementary web 94 in position to be contacted by, and laminated to, the extruded web 95. After formation, the composite web 99 can be wound into a storage roll or passed through further operations such as slitting or cutting, or adding of further layers or materials.

Figure 24:
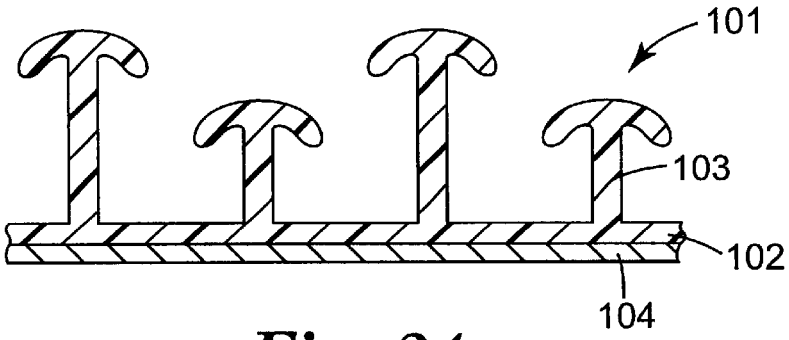

FIG. 24 illustrates the kind of product that may be formed by lamination. The illustrative fastener of the invention 101 shown in cross-section in FIG. 24 comprises a base sheet 102 and ribs 103 projecting from one side of the base sheet, and in addition includes a web 104 laminated to the base sheet. The web 104 may take any of a variety of forms, e.g., film (e.g., reinforcing, aesthetic, imprintable, flame-retardant, friction-enhancing or -reducing); woven or non-woven fabric; foam or sponge; net, gauze or scrim; fastening structure such as a fastening structure of the present invention or a hook or loop structure; or adhesive layer. Important benefits of an added layer include reinforcement (e.g., increased tensile strength in one or more directions in the plane of the web), addition of another function such as adherability, informing (e.g., by inclusion of a web that carries printed or coded information, or a web on which information can be written), flame-retardancy, fluid management, and cosmetic appeal.

Figure 23:
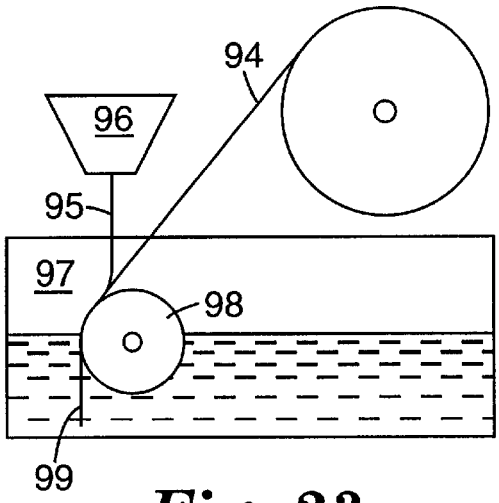
FIG. 23 is a schematic view of apparatus for forming certain binding straps of the invention.

Although there are many benefits to direct lamination of a supplementary web to a fastener body as shown in FIGS. 23 and 24, a supplementary web may also be attached to a fastener of the invention by means of an adhesive layer, welding, or other means.

The base sheet of the binding strap should have adequate tensile strength to resist tensions on the strap during use, which may be provided by choice of composition of the base sheet, manufacture of the fastener as a coextruded product with a material for the base sheet specially adapted for use as a tensile strap, or addition of a sheet or layer to the base sheet. Elasticity (e.g., to allow stretching of the strap during application around an article or articles), toughness, flexibility, rigidity, etc. may be selected and controlled by choice of material and coextrusion techniques.

Although binding straps of the invention are commonly used to bundle together various articles, they also may be used only to wrap around a single article, as when an article is being attached to a supporting structure, or when the strap is wrapped around an object to provide support or to hold a smaller article or treatment appliance against the article. In one useful method of the invention, the at least one article being bound comprises a body part and the strap carries a wound dressing.

The ribbed nature of the fastening surface of binding straps of the invention provides a desired alignment feature to the fastening surfaces. The orientation-assisting mating of fasteners occurs whether the ribs are transverse to the length of the binding strap, or parallel to the length, or in another orientation such as diagonal to the length of the binding strap. Also, the ribbed alignment is further assisted by a deviation in ribbed-surface profile, which as discussed above, can cause the mating fastening surfaces to come together with ribs from one fastening surface aligned with spaces between ribs of the other fastening surface.

Although binding straps of the invention generally are used in self-mating combinations, they also can be interengaged with a fastening surface of a different shape or construction. For example, a fastening surface having tall and short ribs as illustrated in FIG. 2 may be interengaged with a fastener in which the ribs are all the same height as illustrated in FIG. 20.

In some embodiments of the invention, the surface of the base sheet opposite from the ribbed surface carries an adhesive layer, or adhesive-foam combination, or other structure that specially adapts the fastener to attachment to another substrate. Binding straps of the invention may also be attached onto a substrate by means separate from the strap, e.g., by a separately applied adhesive, by sewing, welding of base sheet material to the substrate, and other means. Adhesive may also be applied on the fastening surface side, e.g., between ribs, to increase the force required to disengage interconnected fastening surfaces on binding straps of the invention. Pressure-sensitive adhesives can be used; or curable adhesives that cure after the interconnection has been made to increase adhesion, possibly to an essentially permanently fastened condition, can be used. Such adhesive layers can be applied after extrusion or other preparation or during extrusion.

Binding straps of the invention or a longer length of stock material from which binding straps may be cut, as by automated bundling equipment, are often wound into a roll for convenient storage and use. If the binding strap carries a layer of adhesive on the surface opposite from the ribbed surface, particularly a layer of pressure-sensitive adhesive, a release liner may be used between windings to assure easy unwinding of the roll. Alternatively, a release material may be incorporated into the binding strap, e.g., into the ribs or outer rib surface portions; or a release material may be applied to the surface of the fastener that winds against the adhesive layer.

EXAMPLE

The invention is further illustrated by the following example, which is not intended to limit the scope of the invention. Parts, ratios and percentages are by weight unless otherwise indicated.

A melt-processable, ethylene-propylene copolymer (7C55H, supplied by Union Carbide Corporation) was fed into a single-screw extruder (supplied by Davis Standard Corporation) having a diameter of about 64 mm (2.5 in) and an L/D (ratio of length to diameter) of 24:1. The temperature profile of the polymer in the extruder steadily increased from approximately 177° C. (350° F.) to approximately 246° C. (475° F.). The polymer was continuously discharged at a pressure of at least about 0.69 MPa (100 psi) through a neck tube heated to approximately 246° C. (475° F.) into a 20.3-cm-wide (8 in.) Masterflex™ LD-40 film die (supplied by Chippewa Valley Die, Inc.) also heated to approximately 246° C. (475° F.).

The die had a die lip configured to form a polymeric base sheet with ribs on one side as pictured in FIG. 2 and was dimensioned to provide a base sheet having a thickness of about 250 microns ($\mu$m), tall ribs 19*a* having a height of 1.78 mm (the dimension 72 in FIG. 4*b*, measured from the upper surface of the base sheet to the topmost portion of the flanges), short ribs 19*b* having a height of 1.14 mm, a stem thickness or width of 0.25 mm (the dimension 78 in FIG. 4*b*, measured at the mid-height of the tall stem), a flange thickness of 0.23 mm (the dimension 79 in FIG. 4*a*, measured at the point where the flange is connected to the stem; the 0.23 mm thickness of the flange is regarded as essentially the same as the 0.25 mm thickness of the stem), a flange width of 0.38 mm (the dimension 74 in FIG. 4*a*, which is the average distance from the center of the stem to the farthest point on the flanges, measured in a plane parallel to the base sheet). The distance from the bottom edge of the flange of the tall rib to the base sheet was 1.22 mm and from the bottom edge of the flange of the short rib to the base sheet was 0.58 mm. As can be calculated, the height ratio of the alternating high and low ribs was approximately 1.5.

The extruded ribbed-surface film was drop cast at about 3 m/min into a quench tank maintained at a temperature of about 10 to 16° C. (50–60° F.) and the film held in the tank for at least 10 seconds. The quench medium was a solution of water and about 0.1–1% of a surfactant, Ethoxy CO-40 (a polyoxyethylene castor oil available from Ethox Chemicals, LLC, Greenville, S.C.), to increase wetting and stabilize rib formation. The quenched rib-surfaced film was air-dried and collected in 100–150 yard (90–137 m) rolls. Binding straps as pictured in FIG. 1 were then cut from the extruded web and tested, whereupon it was found that they exhibited modest engagement forces, good resistance to peeling type disengagement, and a good ratio of engagement to disengagement forces.

What is claimed is:

1. A method for binding at least one article, comprising (a) at least partially surrounding the article with a first elongate strap portion that comprises a base sheet having oppositely facing first and second major surfaces and being configured on at least one major surface with an array of parallel, narrowly spaced, elastically deformable ribs projecting integrally from the base sheet; the ribs comprising a stem portion attached to and substantially upright from the base sheet and a flange attached to at least one side of the stem portion and spaced from the base sheet; the underside surface of the outer portion of at least some flanges projecting downwardly toward the base sheet; the array of ribs establishing a first fastening surface that can be pressed against and thereby interconnected with an identical fastening surface; and the flange having a substantial thickness over most of its width such that the stem portion deforms in preference to the flange during peel-type disengagement from an identical fastening surface; and (b) interconnecting the first fastening surface with a second fastening surface carried on a further structural member disposed around the article.

2. A method of claim 1 in which the flange has a thickness about the same as the thickness of the stem portion.

3. A method of claim 1 in which a flange is attached to both sides of the stem portion.

4. A method of claim 3 in which the flanges have a thickness about the same as the thickness of the stem portion.

5. A method of claim 3 in which portions of the topmost surface of at least some of the flanges angle downwardly toward the base sheet from the stem portion to form a tapered top rib surface that functions during interengagement of two identical fastening surfaces to direct a rib of one fastening surface into the space between two adjacent ribs of the other fastening surface.

6. A method of claim 1 in which the binding strap has a width of about one centimeter or less.

7. A method of claim 1 in which the further structural member is a second strap portion, and the second fastening surface is identical to the first fastening surface.

8. A method of claim 7 in which the first and second strap portions are integrally connected parts of one strap.

9. A method of claim 8 in which the first and second fastening surfaces are disposed on the same major surface of the strap.

10. A method of claim 9 in which the strap includes at least one opening through which an end of the strap may be inserted and the first and second fastening surfaces fastened together.

11. A method of claim 10 in which the first and second fastening surfaces are on the surface of the strap opposite from the at least one article being bound, and fastening is achieved by inserting through the opening a portion of the strap that carries the first fastening surface, and folding that portion back onto a portion of the strap not inserted through the opening, which carries the second fastening surface.

12. A method of claim 11 in which the opening is in the end of the strap opposite the end inserted through the opening.

13. A method of claim 12 in which the second fastening surface is on the end of the strap in which the opening is formed and is adjacent the opening.

14. A method of claim 12 in which the second fastening surface is on a portion of the strap intermediate the opening and the end of the strap inserted through the opening.

15. A method of claim 13 in which the end of the strap inserted through the opening is fastened to the second fastening surface as well as to a third fastening surface disposed on a portion of the strap intermediate the opening and the end of the strap inserted through the opening.

16. A method of claim 8 in which the strap is fastened to a ring member, and fastening is achieved by inserting through the ring member a portion of the strap that carries the first fastening surface, and folding that portion back onto a portion of the strap not inserted through the ring member, which carries the second fastening surface.

17. A method of claim 16 in which the other end of the strap is also inserted through the ring member and fastened by folding the inserted portion, which carries a third fastening surface, back onto a portion of the strap not inserted through the ring member, which carries a fourth fastening surface.

18. A method of claim 9 in which at least one end of the strap is folded back onto itself and held in that position to form a tab at the end of the strap.

19. A method of claim 18 in which the folded-back portion of the strap carries a fastening surface.

20. A method of claim 1 in which the further structural member is a panel having an apertured area comprising at least one opening, and fastening surfaces are disposed on opposite sides of the apertured area adjacent the apertured area; and a first strap portion is inserted through the apertured area and fastened to one adjacent fastening surface, and a second strap portion is inserted through the apertured area and fastened to another adjacent fastening surface.

21. A method of claim 8 in which the first and second fastening surfaces are on opposite major surfaces of the strap.

22. A method of claim 1 in which the at least one article being bound is of a size to be received between adjacent ribs projecting from the base sheet.

23. A method of claim 1 in which the at least one article being bound comprises a body part and the strap carries a wound dressing.

24. A method of claim 1 in which the ribs comprise a stem portion attached to and substantially upright from the base sheet and at least one flange attached to each side of the stem portion and spaced from the base sheet.

25. A method of claim 1 in which the elongate strap portion is made by profile extrusion, with the length of the strap portion being transverse to the machine direction of extrusion.

26. A method for binding at least one article, comprising (a) at least partially surrounding the article with a first elongate strap portion that comprises a base sheet having first and second oppositely facing major surfaces and being configured on at least one major surface with an array of parallel, narrowly spaced, elastically deformable ribs projecting integrally from the base sheet and establishing a first fastening surface that can be pressed against and thereby interconnected with an identically configured fastening surface; the ribs comprising a stem portion attached to and substantially upright from the base sheet and a flange attached to each side of the stem portion and spaced from the base sheet; the underside surface of the outer portions of the flanges projecting toward the base sheet such that when identical fastening surfaces are interengaged, the outer portions of the flanges from one fastening surface nest within the space between the stem portions and outer portion of flanges from the other fastening surface; portions of the topmost surface of at least some of the flanges angling downwardly toward the base sheet from the stem portion to form a tapered top rib surface that functions during interengagement of two identical fastening surfaces to direct a rib of one fastening surface into the space between two adjacent ribs of the other fastening surface; and the flanges having a substantial thickness over at least most of their width such that the stem portion deforms in preference to the flanges during peel-type disengagement from an identical fastening surface; and (b) interconnecting the first fastening surface with a second fastening surface carried on a further structural member disposed around the article.

27. A method of claim 26 in which the further structural member is a second strap portion integrally connected to the first strap portion and carrying the second fastening surface, which is identical to the first fastening surface.

28. A method of claim 27 in which the integral strap includes at least one opening through which an end of the strap may be inserted to fasten the first and second fastening surfaces together.

29. A method of claim 26 in which the elongate strap portion is made by profile extrusion, with the length of the strap portion being transverse to the machine direction of extrusion, and the ribs being transverse to the length of the strap portion.

30. A method of claim 26 in which the binding strap has a width of about one centimeter or less.

31. A binding strap comprising an elongate base sheet having first and second oppositely facing major sides and having an array of parallel, narrowly spaced, elastically deformable ribs on at least one major side projecting integrally from the base sheet; the ribs comprising a stem portion attached to and substantially upright from the base sheet and a flange attached to at least one side of the stem portion and spaced from the base sheet; the array of ribs establishing a first fastening surface that can be pressed against and thereby interconnected with an identical fastening surface; the underside surface of the outer portion of the flanges projecting toward the base sheet, and the flanges having a substantial thickness over at least most of their width such that the stem portion deforms during peel-type disengagement from an identical fastening surface in preference to deformation of the flange attached to the stem portion; and the strap having a length and width adapting the strap to be wrapped around one or more articles to apply a binding action on the article(s).

32. A binding strap of claim 31 in which the stem portion and flange have about the same thickness, and the stem height is greater than the flange width.

33. A binding strap of claim 31 made by profile extrusion, with the length of the strap being transverse to the direction of extrusion, and the ribs being transverse to the length of the strap.

34. A binding strap of claim 31 having a said fastening surface on each of the two major sides of the strap.

35. A binding strap of claim 34 in which portions of at least one major side of the strap are free from ribs.

36. A binding strap of claim 31 in which portions of the side of the base sheet from which ribs project are free from ribs.

37. A binding strap of claim 31 which includes at least one opening in the strap through which an end of the strap may be inserted and interconnected with another portion of the strap during a binding operation.

38. A binding strap comprising an elongate base sheet having first and second oppositely facing major sides and having an array of parallel, narrowly spaced, elastically deformable ribs on at least one major side projecting integrally from the base sheet and establishing a first fastening surface that can be pressed against and thereby interconnected with an identically configured fastening surface; the ribs comprising a stem portion attached to and substantially upright from the base sheet and a flange attached to each side of the stem portion and spaced from the base sheet; the underside surface of the outer portions of the flanges projecting toward the base sheet such that when identical fastening surfaces are interengaged, the outer portions of the flanges from one fastening surface nest within the space between the stem portions and outer portion of flanges from the other fastening surface; portions of the topmost surface of at least some of the flanges angling downwardly toward the base sheet from the stem portion to form a tapered top rib surface that functions during interengagement of two identical fastening surfaces to direct a rib of one fastening surface into the space between two adjacent ribs of the other fastening surface; and the flanges having a substantial thickness over at least most of their width such that the stem portion deforms in preference to the flanges during peel-type disengagement from an identical fastening surface; and the strap having a length and width adapting the strap to be wrapped around one or more articles to apply a binding action on the article(s).

39. A binding strap of claim 38 prepared by coextrusion from at least two different materials, whereby one portion of the binding strap comprises one material and a different portion of the binding strap comprises a different material.

40. A binding strap of claim 38 which comprises a supplementary web attached to the base sheet on the side opposite from which ribs project.

41. A binding strap of claim 38 which carries a layer of adhesive on the side of the base sheet opposite from which ribs project.

42. A fastener comprising a base sheet having first and second oppositely facing major surfaces and being configured on at least one major surface with an array of parallel, narrowly spaced, elastically deformable ribs projecting integrally from the base sheet; the ribs comprising a stem portion attached to and substantially upright from the base sheet and a flange attached to each side of the stem portion and spaced from the base sheet; the underside surface of the outer portion of the flanges projecting downwardly toward the base sheet; the array of ribs establishing a first fastening surface that can be pressed against and thereby interconnected with an identical fastening surface; and the flange having a substantial thickness over most of its width such that the stem portion deforms in preference to the flange during peel-type disengagement from an identical fastening surface.

43. A fastener of claim 42 in which the flanges have a thickness about the same as the thickness of the stem portion.

44. A fastener of claim 42 in which portions of the topmost surface of at least some of the flanges angle downwardly toward the base sheet from the stem portion to form a tapered top rib surface that functions during interengagement of two identical fastening surfaces to direct a rib of one fastening surface into the space between two adjacent ribs of the other fastening surface.

45. A fastener of claim 42 in strip form about one centimeter or less in width.

46. A method of claim 1 in which the flange has a thickness at least about three-fourths as thick as the stem portion over nine-tenths or more of the flange's width.

47. A method of claim 26 in which the flanges have a thickness at least about three-fourths as thick as the stem portion over nine-tenths or more of their width.

48. A binding strap of claim 31 in which the flange has a thickness at least about three-fourths as thick as the stem portion over nine-tenths or more of the flange's width.

49. A binding strap of claim 38 in which the flanges have a thickness at least about three-fourths as thick as the stem portion over nine-tenths or more of their width.

50. A fastener of claim 42 in which the flanges have a thickness at least about three-fourths as thick as the stem portion over nine-tenths or more of their width.

* * * * *

UNITED STATES PATENT AND TRADEMARK OFFICE

CERTIFICATE OF CORRECTION

PATENT NO. : 6,588,074 B2
DATED : July 8, 2003
INVENTOR(S) : Galkiewicz, Robert K.

It is certified that error appears in the above-identified patent and that said Letters Patent is hereby corrected as shown below:

Column 3,
Line 59, delete “recallable” and insert therefore -- reclosable --.

Signed and Sealed this

Eleventh Day of May, 2004

JON W. DUDAS
*Acting Director of the United States Patent and Trademark Office*